United States Patent [19]

Torii et al.

[11] 4,166,085

[45] Aug. 28, 1979

[54] CARBURETOR

[75] Inventors: Masanori Torii; Tadahisa Naganawa, both of Aichi, Japan

[73] Assignee: Toyota Jidosha Kogyo Kabushiki Kaisha, Toyota, Japan

[21] Appl. No.: 856,595

[22] Filed: Dec. 1, 1977

[30] Foreign Application Priority Data

Jul. 11, 1977 [JP] Japan ..... 52/82750

[51] Int. Cl.[2] ..... F02M 33/02

[52] U.S. Cl. ..... 261/72 R; 123/136

[58] Field of Search ..... 55/DIG. 28, 316; 261/72 R; 123/136

[56] References Cited

U.S. PATENT DOCUMENTS

| | | | |
|---|---|---|---|
| 3,352,294 | 11/1967 | Biller et al. | 123/136 |
| 3,548,797 | 10/1968 | Hagihara et al. | 261/72 R |
| 3,572,013 | 3/1971 | Hansen | 123/136 |
| 3,572,014 | 3/1971 | Hansen | 55/316 |
| 3,646,731 | 3/1972 | Hansen | 123/136 |

FOREIGN PATENT DOCUMENTS

| | | | |
|---|---|---|---|
| 2302736 | 5/1974 | Fed. Rep. of Germany | 261/72 R |
| 1217347 | 12/1970 | United Kingdom | 261/72 R |

*Primary Examiner*—Tim R. Miles

*Attorney, Agent, or Firm*—Koda and Androlia

[57] ABSTRACT

A carburetor including an inner vent communicating with an air intake of the carburetor, an outer vent communicating with an evaporated fuel gas absorbing charcoal cannister and a float chamber. The carburetor is characterized by a connecting portion for directly connecting the inner vent and the outer vent without passing through the float chamber and an opening in the connecting portion connecting the inner and outer vents to the float chamber.

9 Claims, 3 Drawing Figures

CARBURETOR

BACKGROUND OF THE INVENTION:

1. Field of the Invention

This invention relates to carburetors and more particularly to carburetors provided with inner and outer vents which are utilized in motor vehicle emission control systems.

2. Prior Art

In prior art carburetors, the inner vent communicates with the float chamber and with an air intake passageway upstream of the venturi-flume or choke valve so that evaporated fuel gas produced in the float chamber is discharged into an air intake passageway of the carburetor and burnt by the engine or the pressure in the float chamber is equalized with the pressure at a portion upstream of the air intake passageway. On the other hand, for the purposes of improving high temperature performance of the carburetor and suppressing the discharge of evaporated fuel gas, an outer vent is provided in the float chamber so that evaporated fuel gas produced in the float chamber is introduced into the charcoal cannister and the crank case via the outer vent when the engine is not being operated and thereafter is sucked out of the charcoal cannister and burnt by the engine when it is operating at some suitable time later.

However, as shown in FIG. 1, in the conventional carburetor 1, the inner vent 2 and the outer vent 3 are open to the float chamber 4. Accordingly, the inner vent 2 and the outer vent 3 communicate through the float chamber 4. When evaporated fuel gas produced in the float chamber 4 is sucked out of the charcoal cannister 5 which communicates with the float chamber 4 via outer vent 3, air which compensates for the sucked out gases flows from the air intake passageway 6 through the inner vent 2 into the float chamber 4. This air flow which passes through the inner vent 2, the float chamber 4 and outer vent 3 scavenges the float chamber 4 and facilitates the evaporation of the low boiling point components in the fuel gas. Accordingly, since the low boiling point components of the fuel gas are evaporated out of the fuel gas contained in the float chamber 4, there have been such drawbacks as starting failures, stalling, rough idling, etc. which occur immediately after the engine has been started.

SUMMARY OF THE INVENTION

Accordingly it is the general object of the present invention to provide a carburetor wherein air flow through the float chamber is prevented.

It is another object of the present invention to provide a carburetor wherein the evaporation of the low boiling point components of the fuel gas is controlled.

It is still another object of the present invention to provide a carburetor which improves starting and reduces stalling and rough idling of the engine shortly after it has been started.

In keeping with the principles of the present invention, the objects are accomplished by a unique carburetor including an inner vent communicating with an air intake of the carburetor, an outer vent communicating with an evaporated fuel gas absorbing charcoal cannister and a float chamber. The carburetor is characterized by a connecting portion for directly connecting the inner vent and outer vent together without passing through the float chamber and an opening provided in the connecting portion and communicating with the float chamber whereby the inner and outer vents are connected to the float chamber.

BRIEF DESCRIPTION OF THE DRAWINGS

The above mentioned features and objects of the present invention will become more apparent by reference to the following description taken in conjunction with the accompanying drawings, wherein like reference numerals denote like elements and in which.

DETAILED DESCRIPTION OF THE INVENTION

Figure 2:
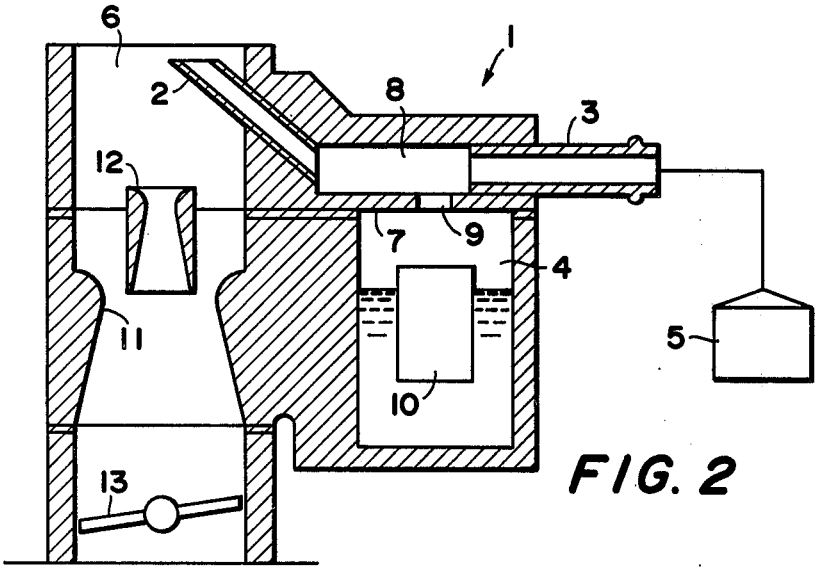
FIG. 2 is a cross-sectional view of a carburetor in accordance with the teachings of the present invention.

Referring more particularly to the figures, shown in FIG. 2 is a cross-sectional view illustrating a carburetor in accordance with the teachings of the present invention. In the following description those elements which are the same as those in the prior art are given like reference numerals and a description of the interconnection and operation will be admitted.

As shown in FIG. 2, the inner vent 2 and the outer vent 3 are connected to each other through a connecting chamber 8 defined by a partition wall 7 which is provided in the upper portion of the float chamber 4. The connecting chamber 8 communicates with the interior of the float chamber 4 through a communicating hole 9 formed through the partition wall 7. The remainder of the functional elements of the carburetor include a float 11 provided in the float chamber 4, a large venturi-flume 11 provided in the air intake 6, a small venturi-flume 12 provided in the air intake 6 and a throttle valve 13 provided in the air intake 6.

Figure 1:
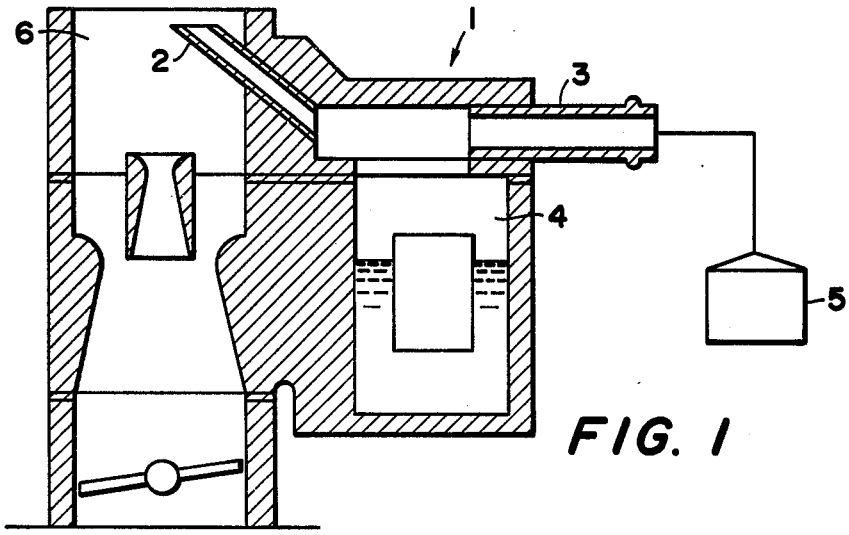
FIG. 1 is a cross-sectional view illustrating a prior art carburetor.

In the prior art embodiment shown in FIG. 1, the evaporated fuel gas which has been produced in the float chamber 4 flowed out the outer vent 3 and was absorbed by the charcoal cannister 5. The resulting pressure drop from this absorption is compensated in part by the air supplied through the air intake passage 6 and the inner vent 2 whereby an air flow is generated which passes through the inner vent 2, the float chamber 4, and the outer vent 3 to the charcoal cannister 5. In contrast thereto, in the embodiment of FIG. 2, the evaporated fuel gas which has been produced in the float chamber 4 flows up into the connecting chamber 8 and out the outer vent 3 to the charcoal cannister 5 where it is absorbed. The pressure drop resulting from this absorption causes an air flow from the air intake passageway 6 through the inner vent 2, the connecting chamber 8 and the outer vent 3 to the charcoal cannister 5.

Since in the embodiment of FIG. 2 the air flow does not pass through the float chamber, the evaporated fuel gas in the float chamber 4 is not scavenged by the air flow. Furthermore, the evaporated fuel gas which has been produced in the float chamber 4 fills up the float chamber 4 and does not as readily escape. Therefore, only part of the evaporated fuel gas which has flowed out into the connecting chamber 8 is absorbed.

Figure 3:
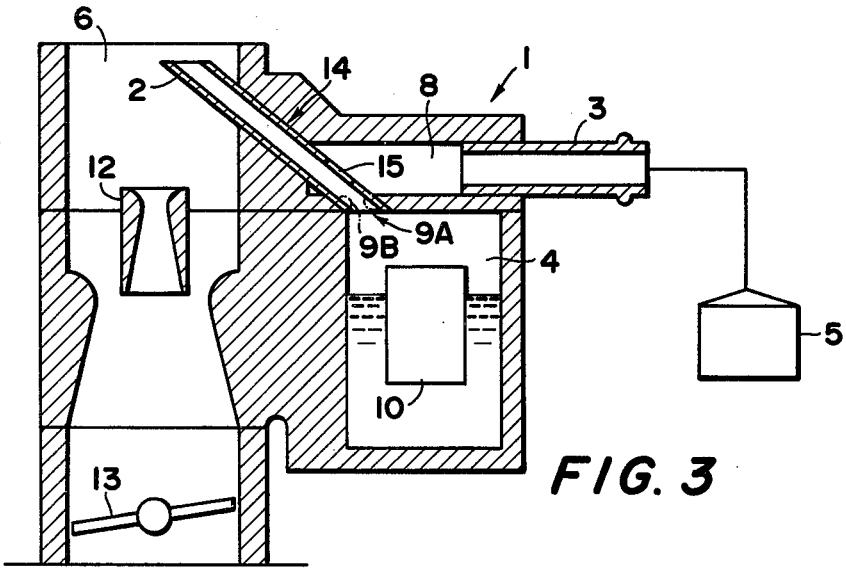
FIG. 3 is a cross-sectional view illustrating a second embodiment of a carburetor in accordance with the teachings of the present invention.

Referring to FIG. 3 shown therein is a second embodiment of a carburetor in accordance with the teachings of the present invention. In FIG. 3 those elements which are substantially the same as in FIG. 1 and FIG. 2 are given like reference numerals and a description of their interconnection and is omitted.

In the second embodiment of FIG. 3 a pipe 14 constituting the inner vent 2 directly extends from the upper end of the throat chamber 4 to the air intake passageway 6. A second communicating hole 15 is formed in a portion of the pipe 14 such that it is located in the connecting chamber 8. Therefore, the inner vent 2 is connected to the connecting chamber 8 and further to the outer vent 3 via the communicating hole 15. In this second embodiment in comparison to the first embodiment, the second communicating hole 15 which substantially connects the inner vent 2 with the outer vent 3 is located to the side adjacent to the inner vent 2 with respect to the communicating hole 9-A of pipe 14 so that the evaporated fuel gas in the float chamber 4 is more effectively prevented from being scavenged by the air flow.

Furthermore, in the above described embodiments, the communicating holes 9 and 9-A are just openings. However, the communicating hole could be preferably designed such that the hole itself prevents the evaporated fuel gas in the float chamber from being scavenged by the air flow through the chamber 8. Accordingly, it might be desirable to make the communicating hole an orifice 9-B as shown by the two dot chain lines in the drawings. Furthermore, the positional relationship between the communicating holes 9, 9-A or the orifice 9-B with the connecting chamber 8 should not necessarily be limited to the embodiments shown in the drawings. However, in order to effectively prevent the evaporated fuel gas in float chamber 4 from being scavaged by the air flow, it is more desirable to provide the connecting chamber at a position higher than the communicating hole 9, 9-A or the orifice 9-B.

As described above, a carburetor is provided wherein the evaporated fuel gas in the float chamber is prevented from being scavaged by air flow from the inner air take 6 to the charcoal cannister 5 when the engine is off. As a result, such advantages as easier starting because of the low boiling point components of the fuel have not been drawn off, engine stalling and rough idling is prevented and deterioration of the fuel gas in the float chamber is reduced are realized.

In all cases it is understood that the above described embodiments are merely illustrative of but a few of the many possible specific embodiments which represent the applications and principles of the present invention. Numerous and various other arrangements can be readily devised by those skilled in the art without departing from the spirit and scope of the invention.

We claim:

1. A carburetor of the type including an inner vent for communicating with an air intake of said carburetor, and outer vent for communicating with an evaporated fuel gas absorbing means and a float chamber, said carburetor being characterized by a connecting portion provided in a body of said carburetor for directly connecting said inner vent and said outer vent without passing through said float chamber and a small opening in said connecting portion to said float chamber.

2. A carburetor according to claim 1 wherein said opening is an orifice.

3. A carburetor according to claim 1 wherein said connecting portion comprises a chamber formed in the top of said carburetor and separated from said float chamber by a partition wall.

4. A carburetor according to claim 3 wherein said inner vent comprises a pipe extending downwardly from said air intake to said float chamber and a hole is provided in said pipe at a point which is located within said chamber and above an end of said pipe extending into said float chamber.

5. A carburetor according to claim 4 wherein said end of said pipe extending into said float chamber is an orifice.

6. A carburetor according to claim 3 wherein said opening is provided in said partition wall.

7. A carburetor according to claim 6 wherein said opening is an orifice.

8. A carburetor according to claim 7 wherein said evaporated fuel gas absorbing means is a charcoal cannister.

9. A carburetor comprising:

a float chamber;

a connecting portion chamber provided in a body of said carburetor;

an outer vent for communicating with an evaporated fuel gas absorbing means provided in a body of said carburetor and extending into said connecting portion chamber;

an inner vent for communicating with air intake of said carburetor, said inner vent comprising a pipe extending downwardly from said air intake to said float chamber through said connecting portion chamber; and a hole provided in said pipe at a point which is located within said connecting portion chamber and above an end of said pipe extending into said float chamber.

* * * * *